United States Patent [19]

Brenner

[11] 4,204,350

[45] May 27, 1980

[54] MOUNTING FOR PHOTOGRAPHS OR THE LIKE

[76] Inventor: Abner Brenner, 7204 Pomander La., Chevy Chase, Md. 20015

[21] Appl. No.: 671,767

[22] Filed: Mar. 30, 1976

[51] Int. Cl.[2] ..... G09F 1/12

[52] U.S. Cl. ..... 40/155; 40/156; 248/489

[58] Field of Search ..... 248/473, 488, 490; 40/155, 156

[56] References Cited

U.S. PATENT DOCUMENTS

| | | | |
|---|---|---|---|
| 1,481,120 | 1/1924 | Brombosz | 40/155 |
| 1,963,124 | 6/1934 | Free | 40/155 |
| 2,403,491 | 7/1946 | Bogia | 40/152.1 |
| 2,651,129 | 9/1953 | Spertus | 40/156 |
| 2,885,166 | 5/1959 | Lehni et al. | 248/490 |
| 3,425,147 | 2/1969 | Marx | 40/155 |
| 3,665,628 | 5/1972 | Dammond | 40/155 |
| 3,916,549 | 11/1975 | Storch et al. | 40/152.1 |
| 3,924,307 | 12/1975 | Tate | 40/156 |

FOREIGN PATENT DOCUMENTS

| | | | |
|---|---|---|---|
| 216292 | 1/1957 | Australia | 40/152.1 |
| 1121210 | 4/1956 | France | 40/156 |
| 325219 | 3/1935 | Italy | 40/156 |

*Primary Examiner*—Louis G. Mancene
*Assistant Examiner*—Wenceslao J. Contreras
*Attorney, Agent, or Firm*—Lawrence I. Field

[57] ABSTRACT

A method of mounting photographs, posters, prints, textiles or other art work for display, which comprises placing the same between two sheets of plastic, providing a plurality of channel clamps at a plurality of locations along the perimeter of said sheets, and exerting a compressive force upon said sheets by means of screws in said channel clamps.

4 Claims, 13 Drawing Figures

MOUNTING FOR PHOTOGRAPHS OR THE LIKE

At the present time, certain types of posters are very much in vogue for decorative purposes. These are colored printings on large sheets of thin paper (not cardboard), 4 to 5 mils thick, and often measuring 2 feet by 3 feet or larger. These posters deal with many subjects. Museums issue posters with reproductions of art subjects when holding special exhibitions and these posters are especially desirable. Young adults and especially college students use posters to decorate their habitations, because they are relatiavely inexpensive and provide a large area of pleasing color or subject matter.

However, mounting such a large area as a poster in a conventional frame is expensive. Furthermore, since posters are usually of only temporary interest and eventually are discarded and replaced, the aggregate cost of all the mounting could be prohibitive. Hence, posters are often mounted in some makeshift manner or simply adhered to the wall with plastic tape. A conventionally framed mounting for one poster cannot be used for another poster without some alteration of the size of the frame, coverglass, cardboard backing and matt. This alteration requires almost as much time and skill as the preparation of the original mounting, and the average individual has neither the tools nor the interest in performing this task.

This invention is particularly directed toward the mounting of art posters. The method has the advantage that a mounting for a given size of poster can be used without alteration for any poster of similar or smaller size. Furthermore, the exchange can be made by anyone within a few minutes merely by loosening and then retightening several set screws.

The present invention comprises a method of mounting photographs, prints, posters, and textiles between two transparent sheets in a manner that they appear to be suspended in space or to be "free floating". The method is economical; it is simple to perform; it safeguards the mounted material; and the result is esthetically pleasing.

In conventional framing of pictures, the frame itself is the load bearing or structural element of construction. That is, the frame either supports the painting directly or the cardboard matt upon which the painting may have been glued. The backing, which usually consists of cardboard, and the front glass pane serve only as protective barriers and afford no structural strength to the assembly.

In the present invention, the photograph, print, poster, or textile (hereinafter referred to as the "picture plane") is compressed between sheets of transparent material, preferably sheets of transparent or translucent synthetic resin or plastic. These two sheets are the structural elements or the load bearing members in contrast to the conventional mounting of pictures by framing.

The compression of the picture plane is effected by means of lengths of channel-shaped metal, preferably of aluminum, which are provided with forcing screws. These channel pieces are placed along the perimeter, or at selected places along the perimeter, of the two sheets of plastic, between which the picture plane is sandwiched. By turning the forcing screws the two sheets of plastic are pressed tightly together and hold the picture plane in place. Extruded metal channel is a common commercial product that is manufactured in a variety of sizes. If the channel pieces extend along the entire perimeter of the two plastic sheets, the resulting assembly has the appearance of a conventionally framed picture, although the structure is quite different. However, it is not necessary to cover the entire perimeter, as short channel pieces can be applied at selected places along the perimeter and yet compress the two sheets together with sufficient force to hold the picture plane in place.

The most striking property of the compression method of mounting is that the picture planes can be made to appear to be "free floating". This is a consequence of the fact that the picture plane need not fill the whole area of the plastic sheets, since it is held in place by compression, but a clear area of any arbitrarily selected size can be left around the perimeter of the picture plane. This causes the picture plane to appear to be suspended in space or to be free floating, and the effect is esthetically pleasing. The free space around the picture plane can be arbitrarily large, for example, a postage stamp could be mounted between plastic sheets four feet square and appear to have no visible support.

It is to be understood that the method of compression mounting is applicable to picture planes which range in thickness from that of thin paper (1/1000 of an inch, for example) to cardboard or textiles. The method is not intended for mounting conventional oil paintings, which have a thick, irregular buildup of oil and pigment, except in a manner to be described below which leaves the front surfaces uncovered.

By virtue of the simple method of holding a picture plane suspended between two sheets of plastic by compression, a given set of plastic sheets and channel members can be used to mount picutre planes of a continuous range of dimensions, extending from something dimunitive up to the full size of the plastic sheets. Thus, as assembly of a given size of plastic sheets and channel members can be reused any number of times for any number of picture planes up to the size of the plastic sheets. In contrast, conventional methods of framing requires that a frame, a glass pane, and a backing be cut to a certain size for a given picture and the assembly cannot be reused without a complete remodelling, which is equivalent to making a new frame.

The materials comprising the mounting assembly can be varied. The clear plastic sheets can consist of acrylic resin, such as Plexiglass or Lucite (polymethylmethacrylate), polystyrene, polycarbonate, polyvinyl chloride, or polypentamethylene. The channel members can be made of metals such as aluminum, brass or stainless steel, or of non-metals such as polymers, glass or wood. When glass sheets are used, it is preferred that they be compressed together by means of plastic forcing screws. For most purposes it is preferred to use Plexiglass or Lucite sheets, as these are the most economical and available materials and can be obtained in a large range of sizes. For channel members, aluminum is preferred because it is less expensive than most other metals and is available in a large range of sizes and finishes and colors.

However, this invention should not be considered to be limited to the employ of rectangular channel shapes. The compression could also be achieved with members made from material with a circular cross section. For example, a tube could be slotted its full length by milling or could be made in this shape by extrusion. It could then be provided on the side with forcing screws by drilling and tapping.

The following is a detailed description of a typical mounting which employs the preferred materials: Plexiglass sheet and aluminum channel.

The picture plane which is to be mounted is a paper poster having the dimensions 24 by 36 inches. It is placed between two sheets of Plexiglass, each having the dimensions 32 by 42 inches. One Plexiglass sheet is ⅛ inch thick and the other is 3/16 inch thick, the total thickness being 5/16 inch. The channel members around the perimeter are made of aluminum channel which is ⅝ inch on a side and has a wall thickness of ⅛ inch. This channel, thus has a groove of ⅜ inch width and a depth of ½ inch. This channel, which is commerically extruded, comes in 16 foot length. When the two sheets of plastic are inserted in the groove, a space of 1/16 inch remains between the plastic and the back side of the groove.

The compressing of the two plastic sheets is effected by means of set screws. The back side of the channel (the side that faces the wall) is drilled and tapped, for example to take a 10/24 set screw with a hollow hexagonal head, preferably of stainless steel. If the set screw is 3/16 inch long, it will not project above the channel when tightened. At least two set screws are used for each section of channel clamp. A set screw should be placed about one inch from the end of a channel section and an additional set screw should be placed about every foot of length along the channel. When the set screws are tightened, they press the two sheets of plastic tightly together with a force of hundred of pounds and hold the enclosed picture plane in the position that it had been set.

The invention will be better understood by reference to the description, taken in conjunction with the drawings in which.

Figure 1A:
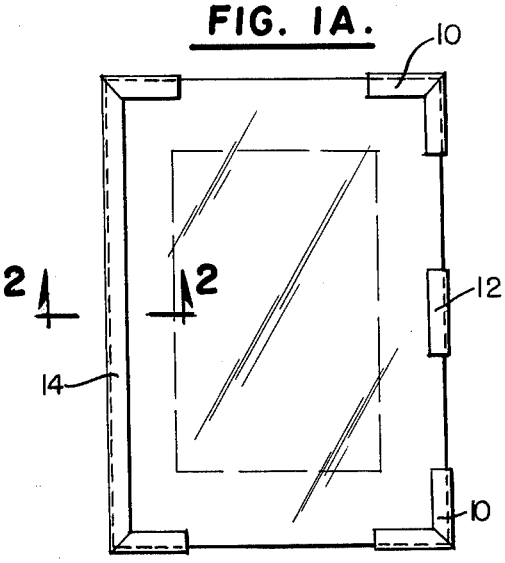
FIG. 1A is a front elevation of a preferred embodiment of the invention.
Figure 1B:
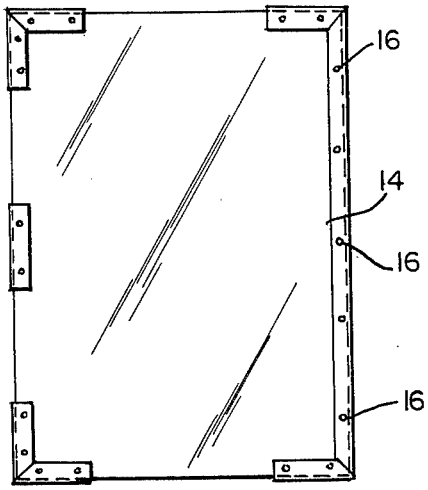
FIG. 1B is a rear elevation of the embodiment of FIG. 1A.
Figure 2:
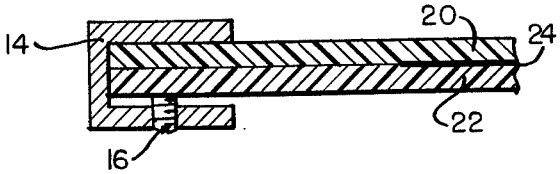
FIG. 2 is a view in section taken on plane 2—2 of FIG. 1A.

FIGS. 1A, 1B and 2 show the invention using two sheets, 20 and 22, of plastic with a subject 24 held between them by means of channel clamps 10, for the corners and 12, 14 for the sides. Channels 10 are cut at any desired angle, for example, a 45° angle. The front face and adjoining sides of the channel are brought to a bright or mirror finish on a cloth buffing wheel, or the channel may be colored by anodizing or painted or otherwise provided with a desired finish. The subject 24 is held in place by the use of screws 16 which holds sheets 20 and 22 securely within channel 14.

Figure 11:
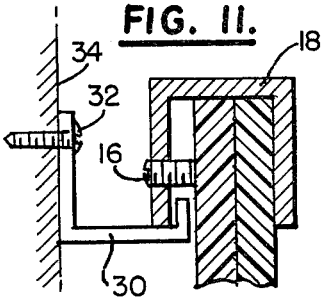
FIG. 11 shows one way of hanging the embodiments of FIGS. 1-10.

The mounted picture plane can be hung on a wall in a conventional manner, for example with hooks and wire, but it is more pleasing to do this in a manner that hides the supports. FIG. 11 shows one simple manner of accomplishing this, taking advantage of the 1/16 inch space between the plastic sheets and the side of a channel, preferably a channel 18 along the top of the picture plane. This space can be made to engage and rest on a L shaped member 30 fabricated from this sheet metal and screwed to the wall 34 by a screw 32 or the channel 18 can directly engage the heads of two flat head screws (not shown) which would be set in the wall. The heads of these screws will remain hidden behind the channel clamp 18.

Although very simple in execution, the method herein described of channel clamp compression with free floating mounting of picture planes is capable of many interesting variations and extensions.

It has already been mentioned that some free space can exist between the picture plane and the channel clamps. If the picture plane and the channel clamp have substantially no free space between them, then the result resembles conventional framing, except that the method of mounting, of course, is quite different.

Figure 3:
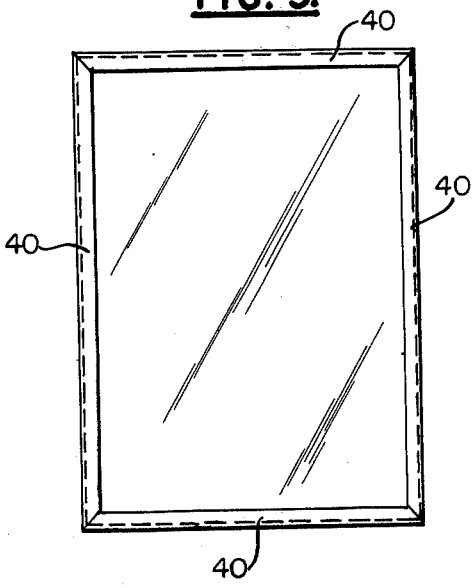
FIGS. 3, 4, 5 and 6 are views similar to FIG. 1A showing modifications thereof.

FIG. 3 shows four channel clamps 40 making a complete frame around the periphery of the plastic sheets. The dimensions of the channel clamps and the length of the channels can vary widely. If the channel completely surrounds the perimeter of the plastic sheets, then the result has a more or less conventional appearance.

Figure 4:
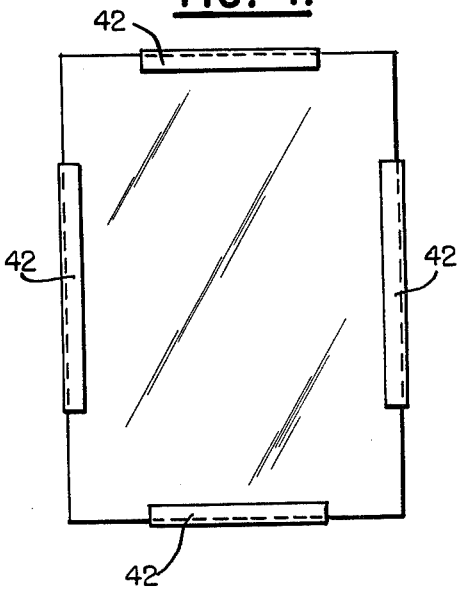
Figure 5:
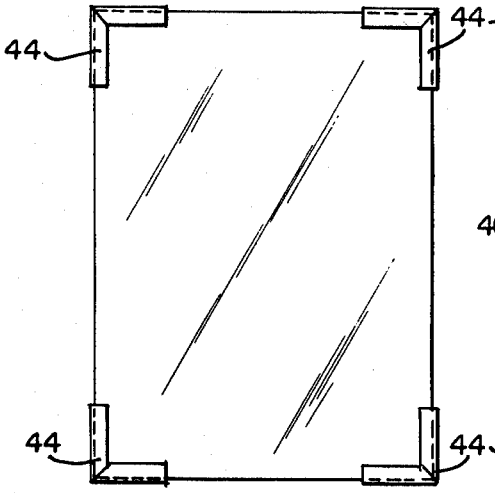

FIG. 4 illustrates one economical manner of using channel clamps 42 wherein small individual pieces of channel clamp a few inches long are used, leaving most of the perimeter of the plastic sheets exposed. The periphery of the plastic is only partly covered and the clamps are used only on the sides. This avoids the greater expense of making corner channel clamps with a 45° angle and the associated need for fit. The use of corner channel clamps 44 is illustrated in FIG. 5, in which channel clamps are used only at the corners of the plastic sheets.

Figure 6:
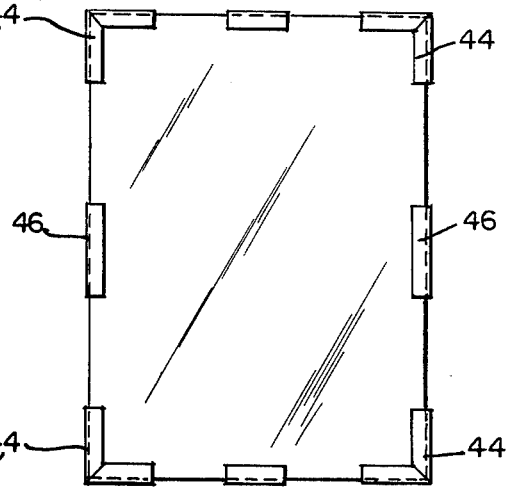

FIG. 6 shows a mounting which uses two types of channel clamps, the side channel clamps 46 and the corner channel clamps 44, but most of the periphery of the plastic sheets is exposed. FIGS. 4, 5 and 6 illustrate that the periphery does not need to be completely enclosed by channel clamps to obtain satisfactory compression of the poster.

Figure 7:
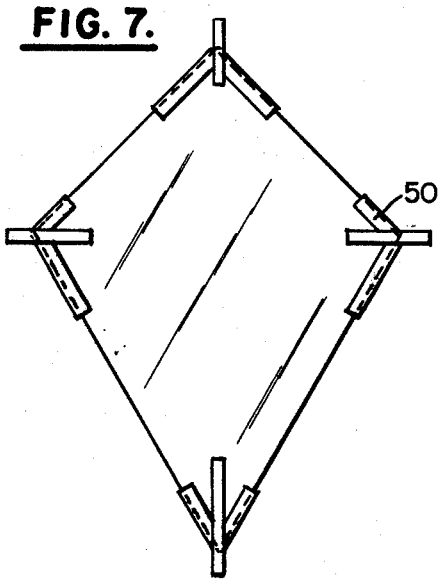
FIG. 7 illustrates the invention applied to a nonrectangular embodiment.

Interesting variations in the shape of the mounting can be made because of the ease with which the materials of construction (aluminum and plastic) can be shaped by cutting, sawing, or machining. For example, the plastic sheets do not need to be rectangular, they can be sawed or cut into any desired shape. In FIG. 7, the plastic sheets and accessory channel clamps 50 have been shaped to represent a stylized shield.

Figure 8:
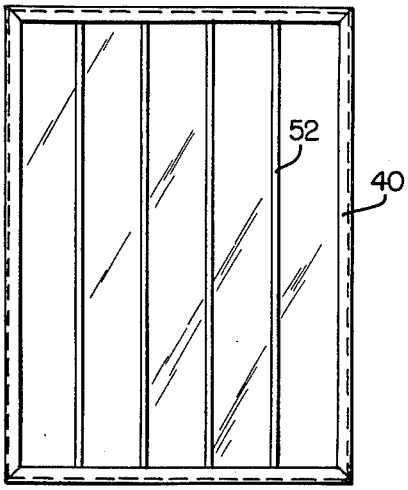
FIG. 8 illustrates the addition of bars to the modification shown in FIG. 3.

Another variation possible with the present invention is that the channel clamps can be utilized to carry a variety of accessories which add to the interest or esthetic appeal of the mounting. One such variation involves the embellishment of the appearance of the channel clamps, which by themselves may appear too plain. Since there may be a space or groove between the two sheets of plastic and the channel clamp, this space can be utilized for the insertion of borders of thin strips of colored plastic, paper, or metal. FIG. 8 shows four vertical aluminum strips 52 to give the effect of the subject of the picture plane seen through the bars of a cage suitable for certain subjects.

Figure 9:
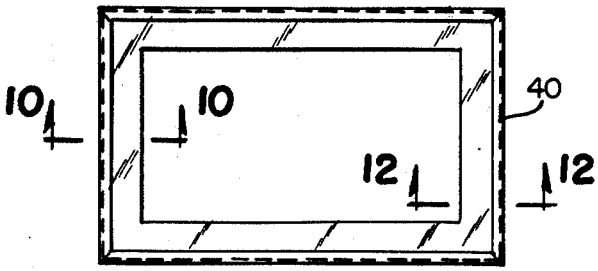
FIG. 9 is a showing in which one of the panels is cut away to accommodate a non-planar subject.
Figure 10:
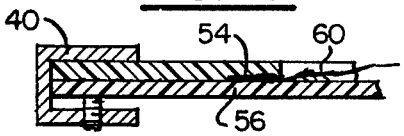
FIG. 10 is a section taken on plane 10—10 of FIG. 9.

FIGS. 9 and 10 show a further modification suitable to the mounting subjects which may not be planar between two plastic sheets 54, 56. As shown, an aperture in the central area 60 of one of the two plastic sheets is provided to accommodate the offset areas of the picture plane.

Figure 12:
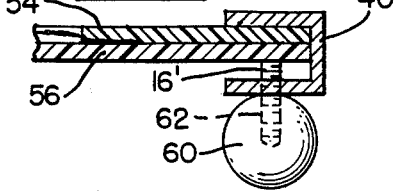
FIG. 12 is a section taken on plane 12—12 of FIG. 9, showing a further feature of the invention.

FIG. 12 illustrates one method of supporting the mountings of any of the previous figures on a horizontal surface instead of vertically. In the embodiment shown in FIG. 12, screw 16 which exerts compression on plastic sheets 54 and 56 extends through the wall of channel 40. A bead 60 screws onto the extension of screw 16 and acts as a foot for the assembly, similar feet being provided to space the mounting above a table or other flat surface.

The invention herein described has a number of advantages over conventional methods of framing photographs, posters, prints and textiles and these are summarized as follows:

1. EASE OF ASSEMBLY:

Only a hexagonal wrench is needed, if Allen type of set screws are used, or a screw driver, if the set screws have a head. No hammer, nails, cutting or sawing is required, nor backing materials.

2. REUSE:

Unlike conventional framing, the invention herein described can be reused over and over again for any picture plane smaller than the size of the plastic sheets, and the removal of one picture-plane and substituting of another can be done by anyone within a few minutes and with only a wrench or screw driver.

3. FREE-FLOATING:

The free-floating, see-through mounting is esthetically pleasing.

4. NONWRINKLING:

The compression technique of mounting serves to keep the picture from wrinkling or distorting. In conventional mounting, large thin picture planes such as posters tend to wrinkle because only a cardboard backing holds the picture plane against the glass plane.

5. VERSATILITY:

The method of mounting herein described permits the use of a large range of materials (kind of plastic and metal) and shapes, and variation in coverage of the perimeter.

6. ACCESSORIES:

The mounting method permits the use of adjuncts (examples of the bars for a cage, legs for a taboret) which increase the utility of the assembly.

7. NONFRAGILE:

Because the mounting consists of a plastic, such as Plexiglass, and aluminum channel, it is much less fragile and more proof against shock or being dropped than conventional mountings, of which glass could be broken and frames nailed at the corners could be wrenched or distorted.

8. DOUBLE MOUNTING:

Since the picture plane is encased between two transparent sheets, two picture planes of similar size can be mounted back-to-back.

Having now described preferred embodiments of the invention, it is not intended that it be limited thereby except as may be required by the appended claims.

I claim:

1. A mounting for photographs, posters, prints and textiles comprising:

two transparent plastic sheets in face-to-face relation between which said photograph, poster, print, textile or other item to be mounted is received;

means for clamping said sheets together under pressure, said clamping means consisting of four channel pieces each consisting of a web from which two legs extend at right angles to define a rectangular channel disposed so as to engage the periphery of both of said plastic sheets each of said channel pieces extending along the entire length of the sides of said sheets so as to extend around the entire perimeter of said sheets; and each of said channel pieces having mitered ends, to abut the channel pieces at each of its ends, and each of said channel pieces having at least two threaded apertures in one of said legs; and forcing screws received in said threaded apertures in said channel pieces and adapted to apply pressure to said sheets, when screwed into said aperture, said sheets each being of sufficient thickness and rigidity to transmit compressive force to the item to be mounted and thus hold it in whatever position it has been placed between said transparent plastic sheets, and said channel being of such a width that when said sheets are pressed together by said forcing screws, a clearance is formed between one of said legs and the sheet nearest to said leg.

2. A mounting as in claim 1 which comprises two sheets of methylmethacrylate resin and aluminum channel pieces provided with hexagonal hollow-head screws.

3. A mounting as in claim 1 in which the transparent sheets are plastics, selected from the group consisting of polystyrene, nylon, polycarbonate, cellulose acetate, cellulose butyrate, polyvinyl chloride, or any other transparent plastic which has the appropriate thickness and rigidity to transmit to the mounted item, the pressure generated by the forcing screws applied to their periphery.

4. The mounting of claim 1 in which an arbitrarily large area of clear space is provided surrounding the mounted item, whereby the mounted item appears to be suspended in space or free floating.

* * * * *